United States Patent [19]

Irzinski et al.

[11] Patent Number: 4,679,008

[45] Date of Patent: Jul. 7, 1987

[54] SHARP MODE-TRANSDUCER BEND FOR OVERMODED WAVEGUIDE

[75] Inventors: Edward P. Irzinski, Gaithersburg; Jerry A. Krill, Ellicott City; William H. Zinger, Columbia, all of Md.

[73] Assignee: The Johns Hopkins University, Baltimore, Md.

[21] Appl. No.: 686,782

[22] Filed: Dec. 27, 1984

[51] Int. Cl.[4] ..... H01P 1/02; H01P 1/16

[52] U.S. Cl. ..... 333/21 R; 333/249

[58] Field of Search ..... 333/21 R, 137, 135, 333/249, 254

[56] References Cited

U.S. PATENT DOCUMENTS

| | | | |
|---|---|---|---|
| 2,439,285 | 4/1948 | Clapp | 333/21 R |
| 2,706,278 | 4/1955 | Walker | 333/21 R X |
| 2,899,651 | 8/1959 | Lanciani | 333/249 X |
| 3,150,333 | 9/1964 | Bowman | 333/21 R X |
| 3,173,145 | 3/1965 | Bowman | 333/21 R X |
| 3,230,484 | 1/1966 | Lipetz | 333/21 R |

FOREIGN PATENT DOCUMENTS

| | | | |
|---|---|---|---|
| 470881 | 7/1975 | U.S.S.R. | 333/137 |

*Primary Examiner*—Eugene R. LaRoche
*Assistant Examiner*—Benny Lee
*Attorney, Agent, or Firm*—Robert E. Archibald

[57] ABSTRACT

A sharp, mode-transducing bend structure for circular $TE_{01}$ overmoded waveguide systems is formed by first transducing from circular $TE_{01}$ waveguide into multiport rectangular $TE_{10}$ waveguide, performing the desired bend, and then transducing from the multiport rectangular $TE_{10}$ waveguide back into the circular $TE_{01}$ waveguide.

8 Claims, 5 Drawing Figures

SHARP MODE-TRANSDUCER BEND FOR OVERMODED WAVEGUIDE

STATEMENT OF GOVERNMENTAL INTEREST

The Government has rights in this invention pursuant to Contract No. N00024-81-C-5301 awarded by the Department of the Navy.

BACKGROUND OF THE INVENTION

Waveguides can generally be classified as "fundamental mode" or "overmoded"; see, for example, the test by A. E. Karbowiak entitled *Trunk Waveguide Communication,* published by Chapman and Hall Ltd. (1965). A fundamental mode waveguide is designed with dimensions which support only the fundamental electromagnetic field, or mode, configuration for propagation in a given frequency band, i.e., higher-order modes are in a "cutoff" condition. An overmoded waveguide, however, is designed so that several or many modes could be supported, but internal structures are generally provided to suppress all but the desired modal configuration. Fundamental mode waveguides (hereinafter referred to as "conventional waveguide") are far more common, as it is more easily designed and constructed; however, this waveguide is restricted in maximum power capacity and in minimum loss, because of its required cross sectional dimensions. Overmoded waveguide, on the other hand, can be designed to have arbitrarily high power capacity and arbitrarily low attenuation by appropriately increasing the cross section. As described in the aforementioned text by Karbowiak, required suppression of unwanted modes in overmoded waveguides is achieved using dielectric and metallic structures to restrict allowable modes.

Overmoded waveguide has been applied as telecommunications trunk transmission lines and to connect transmitters to communications or radar antennas; see W. D. Warters article entitled "WT4 Millimeter Waveguide Systems: Introduction" *Bell Systems Technical Journal,* Vol. 56, No. 10, December 1977, pp. 1825–1827 and that of R. M. Collins entitled "Practical Aspects of High Power Circular Waveguide Systems", *NEREM Record* 1962, pp. 182–3. As noted previously by Karbowiak, an important type of overmoded waveguide supports the circular $TE_{01}$ mode which has the unique property of decreasing transmission loss with increasing frequency for a given diameter. Although applied most often to exploit this low-loss characteristic, the potential for overmoded waveguide to support much higher power than conventional waveguide has also been considered; see, for example, the above-noted *NEREM Record* article by R. M. Collins, as well as the article by W. Lowenstern, Jr. and D. A. Dunn entitled "On the Feasibility of Power Transmission Using Microwave Energy in Circular Waveguide", appearing in the *Journal of Microwave Power,* Symposium Proceedings, Part B., Vol. 1, No. 2 (1966) pp. 57–61.

A disadvantage of overmoded waveguide is that the associated bends and elbows are larger than their conventional counterparts, primarily to minimize mode conversion; thus, posing a problem for systems with space limitations. As will be described hereinafter, a more compact mode-transducing bend is proposed in accordance with the present invention, employing a high power capacity mode transducer which efficiently couples an overmoded circular waveguide to four or more conventional rectangular waveguides; i.e. a $TE_{01}$ mode overmoded waveguide is transitioned into multiple, smaller cross section, conventional waveguides which are sharply bent and then re-transitioned to an overmoded waveguide. As will also be described in more detail hereinafter, a conventional waveguide bend can be more compact because the cross section is smaller and the mode conversion loss mechanism is not present. Thus, the mode-transducing bend, or elbow, proposed in accordance with the present invention takes advantage of the desirable features of overmoded waveguide, i.e., high power and relatively low loss, while also featuring a desirable characteristic of conventional waveguide, i.e., compactness.

Currently available $TE_{01}$ mode overmoded waveguide elbows and bends can be classified into three basic types: $TE_{01}$ mode gradual bends, miter elbows, and mode-transitioning gradual bends. The most common, and probably highest-performance, type is the overmoded $TE_{01}$ mode bend design which has been extensively analyzed and optimized; see for example, T. N. Anderson article entitled "State of the Waveguide Art", *Microwave Journal,* Vol. 25, No. 12, pp. 22–48 (December 1982), as well as the *Bell System Technical Journal,* Vol. 28, No. 1, pp. 1–33 (January 1947); Vol. 36, No. 5, pp. 1292–1307 (September 1957); and Vol. 37, No. 6, pp. 1599–1663 (November 1958). In particular, the unwanted-mode suppression features of this particular bend configuration include a gradual curvature taper and a wall structure, generally in the form of corrugations, insulated helix wire sheathed in dielectric, or a dielectric lining. Such a bend can be 10–100 times longer than a conventional waveguide bend, depending on the required loss and mode conversion characteristics (which influence cross section and curvature taper). Whereas the larger size may be of little concern at millimeter wavelengths or in the context of increased performance, it may preclude application of overmoded waveguide in many cases, especially at longer wavelengths.

A $TE_{01}$ mode miter elbow has also been previously developed. In its simplest form, two orthogonal circular waveguides are joined with a mirror replacing the outer corner of the intersection, and energy from one waveguide is reflected by the mirror into the other waveguide, see E. A. J. Marcatili article entitled "Miter Elbow for Circular Elective Mode", *Symposium of Quasi-Optics,* Polytechnic Inst. Of Brooklyn, (June 8–10, 1964), pp. 534–543. This particular elbow performs better, and is generally analyzed, in the optical regime, with the waveguide may free space wavelengths in diameter. For less overmoded systems (i.e., smaller diameter relative to a wavelength), a low-loss miter elbow requires flaring the waveguide to a larger diameter at the intersection, as described by F. Sporleder in his paper "A Compact 90° Corner with Expanded Diameter and Elliptic Mirror for Circular Waveguide", *IEE Conference Publ.* 146, (1976), pp. 68–71. Therefore, an overmoded miter elbow is generally not compact as compared relative to a conventional waveguide bend.

As reported by D. A. Lanciani in an article entitled "$H_{01}$ Mode Circular Components", *IEEE Transactions on Microwave Theory and Techniques,* Vol. MTT-2, pp. 45–55, (July 1954), a gradual mode-transducing bend has also been previously constructed which transitions from the circular $TE_{01}$ mode to the cross-shaped $TE_{22}+$ mode, which is the intermediate mode in the wellknown Marie transition (see U.S. Pat. No. 2,859,412). The portion of the bend with the cross $TE_{22}+$ mode has a gradual curvature which preserves the fields in each arm of the cross, to allow proper transitioning back to the $TE_{01}$ mode. The curvature requirements appear similar to those for the $TE_{01}$ mode bend, and therefore, the bend radius is significantly larger than that of conventional waveguide bends.

In summary, the above discussed prior art types of bends for overmoded $TE_{01}$ waveguide are all, in principle, capable of high power and low loss; however, they require large effective bend radius (or volume in the case of the miter elbow) as compared to conventional waveguide.

DESCRIPTION OF THE INVENTION

In light of the deficiencies of the previously proposed bends for overmoded waveguide systems, the need exists for a more compact bend structure which does not sacrifice the high power and low loss advantages of such overmoded systems. Basically, the present invention proposes a mode-transducing elbow structure, involving a transition from the circular $TE_{01}$ mode to the cross $TE_{22}+$ mode, as in the gradual mode transducing bend previously proposed and described hereinabove. However, in the proposed elbow, a further mode transition occurs from the $TE_{22}+$ mode into four separate conventional, rectangular $TE_{10}$ mode waveguides, for example. The rectangular waveguides, in practice, can be bent with a short bend radius since mode conversion loss is not present. As long as the rectangular waveguide bends possess the same phase length, they can be appropriate recombined into the $TE_{22}+$ mode and then the $TE_{01}$ mode to complete the elbow.

In light of the above discussion, an object of the present invention is to provide a sharp, mode-transducing bend for use in overmoded waveguide systems.

Another object of the present invention is to provide a compact bend structure adapted to interconnect sections of circular $TE_{01}$ mode waveguide, without sacrificing the high power capacity and low loss features associated herewith.

Other objects, purposes and characteristic features of the present invention will, in part, be discussed as the description of the invention progresses and will, in part, be obvious from the accompanying drawings, wherein.

Figure 2:
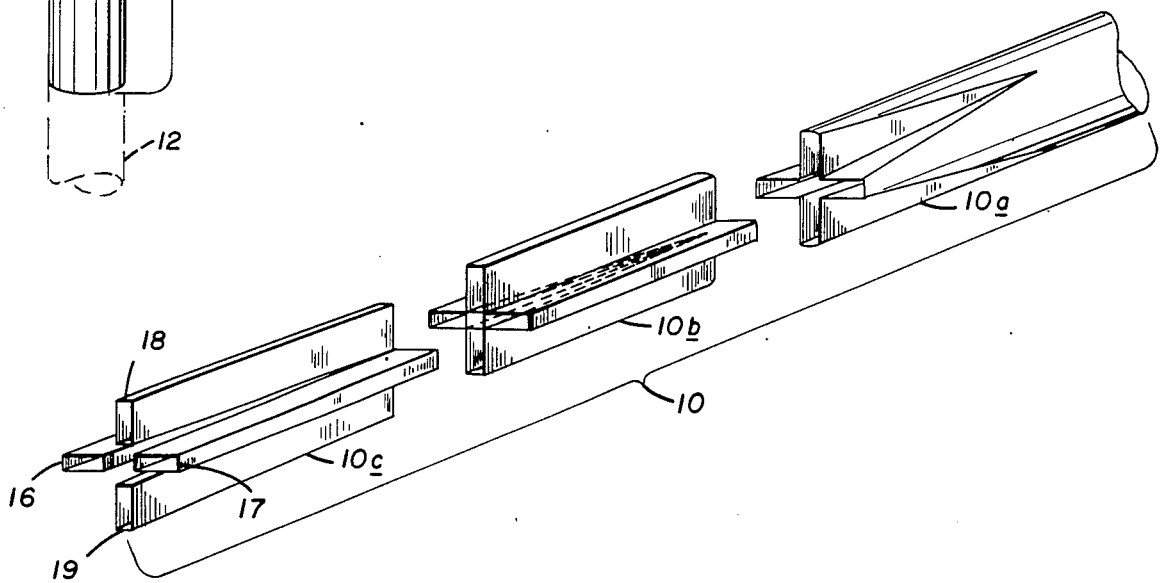
FIG. 2 PRIOR ART
FIG. 2 is a perspective view of a prior art circular to rectangular mode transducer structure relating to the present invention.

Referring first to FIG. 2 of the drawings, a multi-port rectangular $TE_{10}$ to circular $TE_{01}$ mode transducer is illustrated and comprises a structure that is described in detail in U.S. application, Ser. No. 532,892, filed Sept. 16, 1983, by W. H. Zinger and J. A. Krill, now U.S. Pat. No. 4628287, issued 9 Dec. 1986, and having a common assignee with the present application. Basically, the transducer 10 of FIG. 2 has three sections; right-hand section 10*a* which transitions from a circular $TE_{10}$ waveguide cross-section into an intermediate cross-shaped $TE_{22}+$ mode, similar to the Marie transducer; a central section 10*b* which converts the intermediate mode into four rectangular $TE_{10}$ modes, by means of an internal pyramidal structure (shown in dashed lines in FIG. 2) which forms the inner wall of each of the rectangular waveguides; and, a left-hand section 10*c* in which the four rectangular waveguides are extended in spatial independence. As discussed in the aforementioned co-pending Zinger and Krill application, the mode transducer shown in FIG. 2 can be applied to configurations wherein the number (n) of rectangular $TE_{01}$ waveguides is other than four, by simply designing the right-hand section 10*a* to transition into (n) segments and then designing the intermediate section 10*b* and internal pyramidal structure to form (n) rectangular waveguide ends; i.e. the pyramid would be n-sided.

Figure 1:
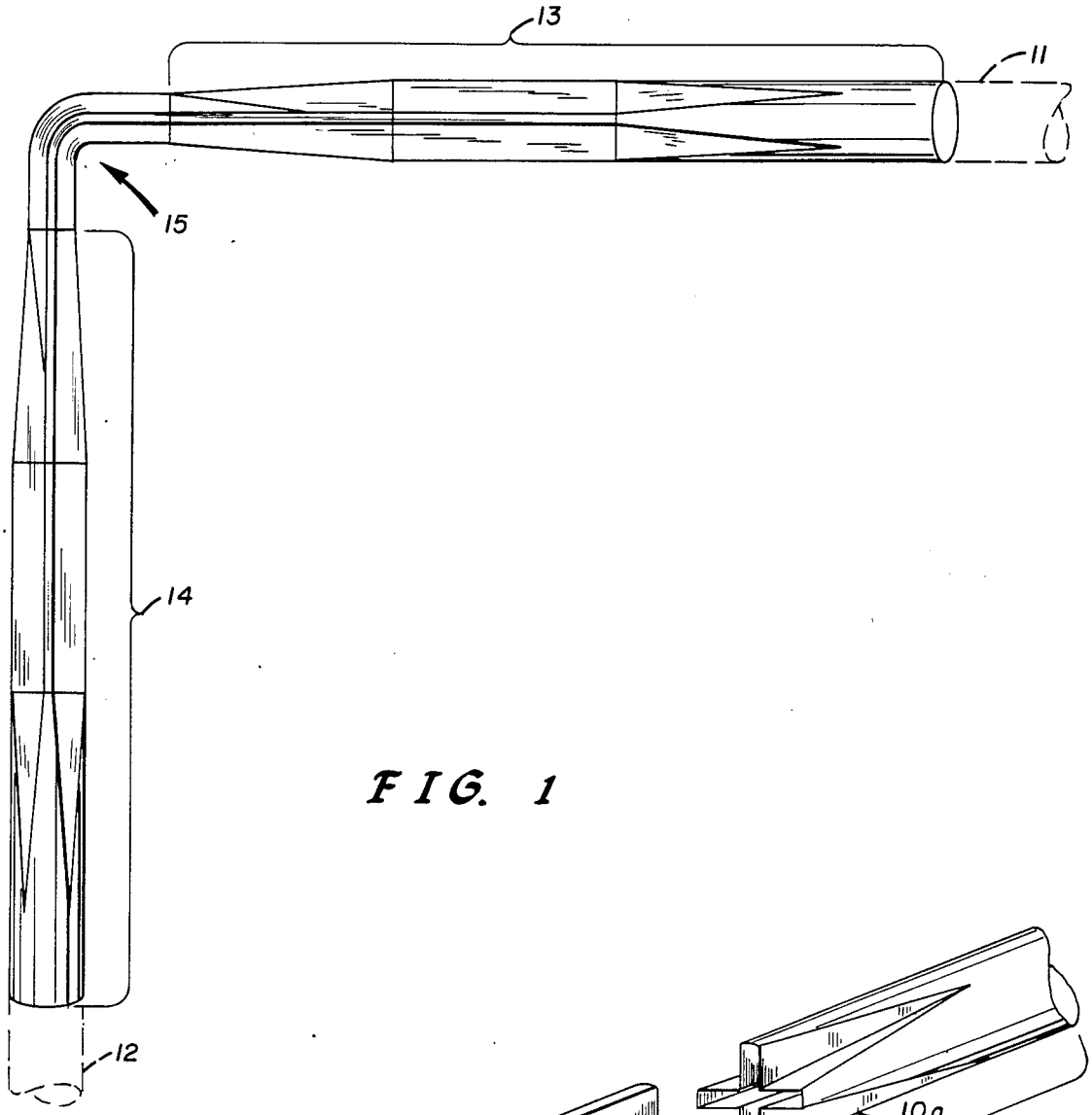
FIG. 1 is a plan view of a 90° bend structure according to the present invention.

By appropriately modifying the transducer structure of FIG. 2, the mode-transducing bend of the present invention is attained. More particularly, FIG. 1 illustrates a sharp mode-transducing bend configuration, in accordance with the present invention, for interconnecting two overmoded circular $TE_{01}$ mode waveguides 11 and 12 whose axes form a 90° angle. As shown, the ends of circular waveguide 11 and 12 are connected to transducers 13 and 14, respectively, which perform circular $TE_{01}$ to multiport rectangular $TE_{10}$ mode transduction and which, in turn, are connected together by means of a pair each of 90° E- and H-plane bends represented generally at 15 in FIG. 1. The mode transducer portions 13 and 14 are each constructed by modifying the transducer structure taught by Zinger and Krill, in application Ser. No. 532,892 (and shown in FIG. 2), in accordance with the present invention.

Figure 3:
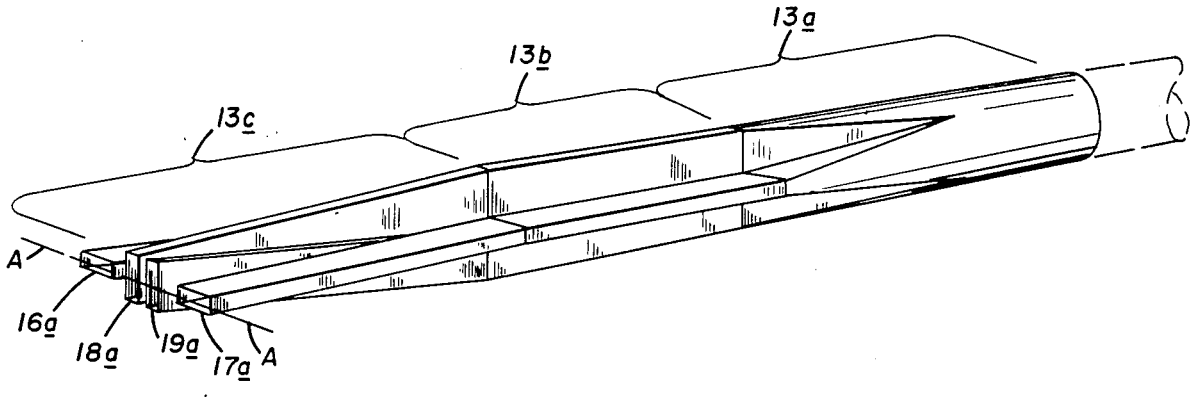
FIG. 3 is a perspective view of a mode-transducing portion of the proposed bend structure of the present invention.
Figure 4:
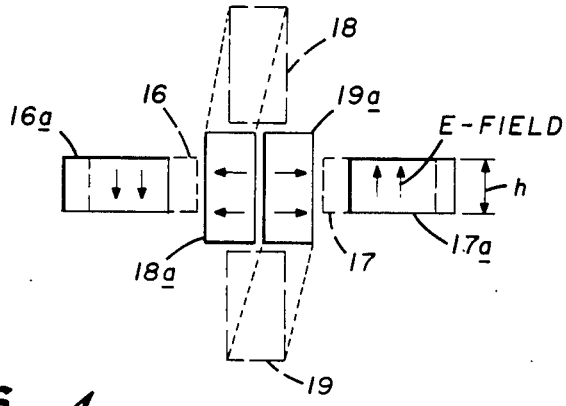
FIG. 4 is a diagrammatic illustration of the manner in which the transducer structure of FIG. 2 is modified in accordance with the present invention.
Figure 5:
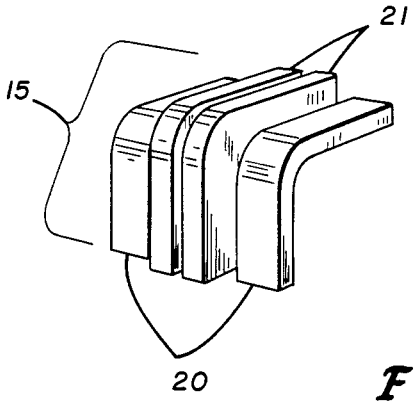
FIG. 5 is a perspective view of 90° E- and H-plane bends employed in the proposed bend structure of the present invention.

More particularly, in the previously proposed transducer structure shown in FIG. 2, the separation between the inner walls of waveguide arms 16 and 17, and between the inner walls of arms 18 and 19 increases by 0.1 $\lambda_0$ for each unit of $\lambda_0$ measured to the left (in FIG. 2) from the right-hand end of section 10*c*, where $\lambda_0$ is the free space wavelength. In accordance with the present invention, to provide the required clearance in the modified mode transducer structures 13 and 14, the arms 17 and 19 would be gradually bent to the right, as shown in FIG. 4, by slightly more than half the height h of the rectangular waveguide, and arms 16 and 18 would be gradually bent to the left by the same amount. If section 13*c*, in FIG. 3, is $3\frac{1}{3}$ $\lambda_0$ long, then the bend rate for elbow clearance shold be an additional 0.15 h per unit of $\lambda_0$ from the right-hand end of section 13*c* in the directions indicated in FIG. 4. Further, to provide proper path length, arm 18 must be bent down and arm 19 bent up so that the axes of all waveguide arms, at their modified end positions 16*a*–19*a*, are aligned along line A—A in FIG. 3. Slight additional separation of arms 16*a* and 17*a* may be required to maintain equal phase length among the four arms. Four transducer 14 of FIG. 1, the same considerations are applied, although in the mirror-image. The resulting arm positions are designated at 16*a*–19*a* in FIGS. 3 and 4, for the transducer section 13*c* corresponding to the modification of section 10*c* in FIG. 2 in accordance with the present invention.

The rectangular waveguide outputs from each transducer 13, and 14 are then connected at 15, to complete the proposed structure, with E-plane and H-plane rectangular waveguide 90° bends 20 and 21 shown in FIG.

5. More particularly, the rectangular waveguide arms 18*a* and 19*a* (and the corresponding arms of transducer 14) are connected to a pair of 90° H-plane bends 21 and the rectangular waveguide arms 16*a* and 17*a* (and the corresponding arms of transducer 14) are connection to a pair of 90° E-plane bends 20. Obviously, if a bend other than 90° is desired, it can be achieved by appropriate selection of E- and H-plane pairs corresponding to the desired bend angle.

In forming the proposed bend structure, care must be taken to maintain the same phase length and impedance in each rectangular waveguide arms 16*a*–19*a*, and phase and impedance matching in the E- and H-plane bends 20, 21 must also be maintained. After positioning the waveguide arms of transducer section 13*c*, as described above, standard techniques may be applied for more refined matching, e.g., slight variations in curvature profiles, guide cross-section shapes, lengths and orientations. Matching in each waveguide arm is necessary to minimize mode conversion in the overmoded components. Analogous considerations may be applied to design a mode transducing bend with a different number of rectangular waveguides.

In operation of the proposed mode-transducing bend structure of the present invention, the circular $TE_{01}$ mode present in waveguide 11 (or 12) in FIG. 1 is first transduced, at 13, into the multi-port (four) rectangular sections, each supporting the $TE_{10}$ mode. These rectangular waveguide sections are then bent sharply, as indicated at 15 in FIG. 1, with no attendant mode conversion loss, and then transduced, at 14, back into the circular $TE_{01}$ mode for waveguide 12 (or 11). The bend or elbow structure thus implemented takes advantage of the desirable features of overmoded waveguide, i.e., high power and relatively low loss, while also featuring a desirable characteristic of conventional waveguide, i.e. compactness.

Various modifications, adaptations and alterations to the proposed structure, over and above those suggested hereinabove, are of course possible in light of the above teaching. Therefore, it should be understood that within the scope of the appended claims the invention may be practiced otherwise than as specifically described.

What is claimed is:

1. A mode-transducing bend structure comprising, a first transducer means for converting a first waveguide supporting a circular $TE_{01}$ mode into a first multiport waveguide supporting the rectangular $TE_{10}$ mode, a second transducer means for converting a second multiport waveguide supporting the rectangular $TE_{10}$ mode back into a second waveguide supporting a circular $TE_{01}$ mode, said first and second multiport waveguide each having an equal plurality of rectangular $TE_{10}$ mode supporting waveguides whose extending ends terminate in a common plane perpendicular thereto and are arranged along a line adjacent to and in substantial alignment with one another within said common plane, with certain of said rectangular waveguides supporting an E-field parallel to said line and others of said rectangular waveguides supporting an E-field transverse to said line, and rectangular $TE_{10}$ mode supporting waveguide bend means configured at a predetermined bend angle for interconnecting the first and second multiport waveguide of said first and second transducer means respectively, said rectangular $TE_{10}$ mode supporting waveguide bend means including an equal plurality of bent rectangular $TE_{10}$ mode supporting waveguides with opposite ends connecting respectively the extending ends of the rectangular $TE_{10}$ mode supporting waveguides of said first and second multiport waveguide about said predetermined bend angle while maintaining said substantial alignment, certain of said bent rectangular waveguides being H-plane bends for supporting said parallel E-field and others of said bent rectangular waveguides being E-plane bends for supporting said transverse E-field.

2. A mode-transducing bend structure comprising, a first transducer means for converting a first circular waveguide supporting a circular $TE_{01}$ mode into four rectangular waveguides each supporting the rectangulr $TE_{10}$ mode, a second transducer means for converting four rectangular waveguides each supporting the rectangular $TE_{01}$ mode back into a second circular waveguide supporting a circular $TE_{01}$ mode, and rectangular $TE_{10}$ mode supporting waveguide bend means configured at a predetermined bend angle for interconnecting the four rectangular waveguides of said first transducer means to the four rectangular waveguides of said second transducer means, said first and second transducer means each comprising, a first means connected to the circular waveguide thereof for converting said waveguide supporting a circular $TE_{01}$ mode to a waveguide supporting a cross $TE_{22}+$ mode, and a second means connected to said first means for converting said waveguide supporting a $TE_{22}+$ mode into four separate rectangular waveguides supporting the $TE_{10}$ mode, and said four separate rectangular waveguides each having an extending end and disposed with their extending ends terminated in a common plane perpendicular thereto and arranged along a line adjacent to and in substantial alignment with one another within said common plane, two of said rectangular waveguides supporting an E-field parallel to said line and the other two of said rectangular waveguides supporting an E-field transverse to said line, and wherein said interconnecting means comprises a pair of E-plane rectangular waveguide bend members for interconnecting between said first and second transducer means the extending ends of said two rectangular waveguide supporting said transverse E-field and a pair of H-plane rectangular waveguide bend members for connecting between said first and second transducer means the extending ends of said two rectangular waveguides supporting said parallel E-field.

3. The mode-transducing bend structure specified in claim 2 wherein said E- and H-plane rectangular waveguide bend members have substantially a 90° bend.

4. The mode-transducing bend structure specified in claim 2 wherein the extending end of each of said two rectangular waveguides supporting said parallel E-field are adjacent on another and interposed between the extending ends of the other two rectangular waveguides supporting said transverse E-field.

5. A mode-transducing bend structure for interconnecting two circular $TE_{01}$ mode waveguide members, comprising, first and second transducer waveguide means, each including a first means connected to a separate one of said circular $TE_{01}$ mode waveguide members for converting said circular $TE_{01}$ mode waveguide member into a cross $TE_{22}+$ mode waveguide, and a second means connected to said first means for converting said cross $TE_{22}+$ mode waveguide into a plurality of separate rectangular $TE_{10}$ mode waveguides, and rectangular waveguide interconnecting means configured at a substantially 90° bend angle as a waveguide bend for interconnecting said first and second transducer means between the respective plurality of separate rectangular $TE_{10}$ mode waveguides thereof, said second means of each transducer waveguide means converting said cross $TE_{22}+$ mode waveguide into four separate rectangular $TE_{10}$ mode waveguides, said four rectangular waveguides each having an extending end and being disposed with their extending ends terminated in a common plane perpendicular thereto and arranged along a line adjacent to and in substantial alignment with one another within said common plane, two of said rectangular waveguides supporting an E-field parallel to said line and the other two of said rectangular waveguides supporting an E-field transverse to said line, and wherein said interconnecting means comprises a pair of E-plane rectangular waveguide bend members for interconnecting between said first and second transducer means the extending ends of said two rectangular waveguide supporting said transverse E-field and a pair of H-plane rectangular waveguide bend members for interconnecting between said first and second transducer means the extending ends of said two rectangular waveguides supporting said parallel E-field.

6. The mode-transducing bend structure specified in claim 5 wherein said E- and H-plane rectangular waveguide bend members have substantially a 90° bend.

7. The mode-transducing bend structure specified in claim 5 wherein the extending end of each of said two rectangular waveguides supporting said parallel E-field are adjacent one another and interposed between the extending ends of the other two rectangular waveguides supporting said transverse E-field.

8. The mode-transducing bend structure specified in claim 1 wherein the predetermined bend angle of said rectangular waveguide bend means is substantially 90°.

* * * * *

UNITED STATES PATENT AND TRADEMARK OFFICE

CERTIFICATE OF CORRECTION

PATENT NO. : 4,679,008

DATED : July 7, 1987

INVENTOR(S) : Edward P. Irzinski et al

It is certified that error appears in the above-identified patent and that said Letters Patent is hereby corrected as shown below:

Column 6, line 66, "on" should be -- one --.

Signed and Sealed this

Twenty-fourth Day of November, 1987

*Attest:*

DONALD J. QUIGG

*Attesting Officer*

*Commissioner of Patents and Trademarks*